US005273117A

United States Patent [19]

Reimert

[11] Patent Number: 5,273,117

[45] Date of Patent: Dec. 28, 1993

[54] SUBSEA WELLHEAD EQUIPMENT

[75] Inventor: Larry E. Reimert, Houston, Tex.

[73] Assignee: Dril-Quip, Inc., Houston, Tex.

[21] Appl. No.: 901,728

[22] Filed: Jun. 22, 1992

[51] Int. Cl.[5] ..... E21B 33/035; E21B 23/02

[52] U.S. Cl. ..... 166/348; 166/208

[58] Field of Search ..... 166/348, 368, 339, 208

[56] References Cited

U.S. PATENT DOCUMENTS

| | | | |
|---|---|---|---|
| 3,543,847 | 12/1970 | Haeber | 166/348 |
| 4,736,799 | 4/1988 | Ahlstone | 166/348 |
| 4,823,871 | 4/1989 | McEver et al. | 166/182 |
| 4,836,288 | 6/1989 | Wester | 166/348 |
| 5,000,266 | 3/1991 | Saunders et al. | 166/387 |
| 5,069,288 | 12/1991 | Singeetham | 166/348 |
| 5,080,174 | 1/1992 | Hymes | 166/382 |

OTHER PUBLICATIONS

Dril-Quip, Inc. Brochure SS 271/02, "Running the 18¾ Hydraulic Rigid Lockdown Wellhead Housing and 20" Casing" (16 pp.).

*Primary Examiner*—Hoang C. Dang
*Attorney, Agent, or Firm*—Vaden, Eickenroht, Thompson, Boulware & Feather

[57] ABSTRACT

There is disclosed subsea well equipment in Which an inner wellhead housing is lowered into and landed in the bore of an outer wellhead housing in order to install an inner casing string suspended from the inner housing within an outer casing string to which the outer housing is connected. The inner housing is locked down in the bore of the outer housing by a locking part on the inner housing which is forced into a locking recess in the bore in order to preload the connection between the housings. An assembly releasably connectable to the inner housing is provided for lowering the inner housing in the landed position and then locking it down within the bore of the housing in response to manipulation of a pipe string from which the assembly is suspended.

12 Claims, 5 Drawing Sheets

FIG. 7
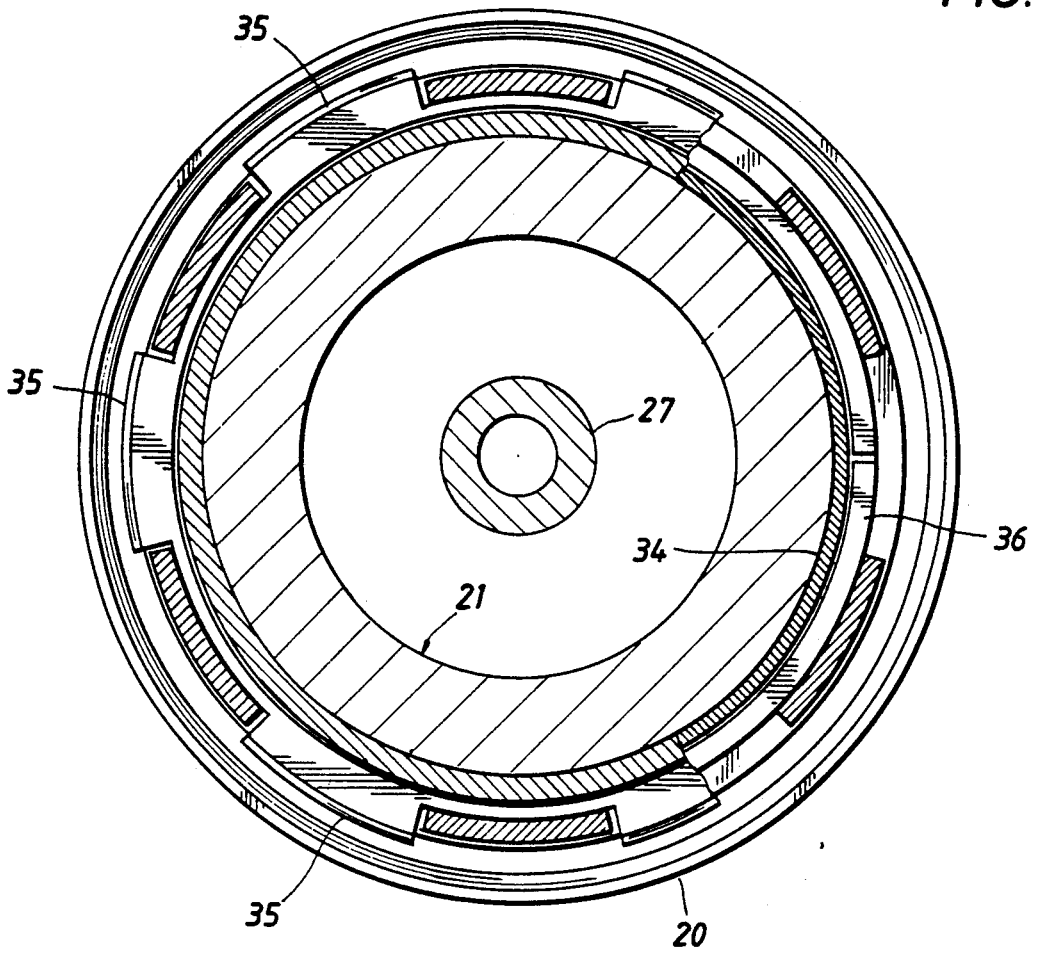
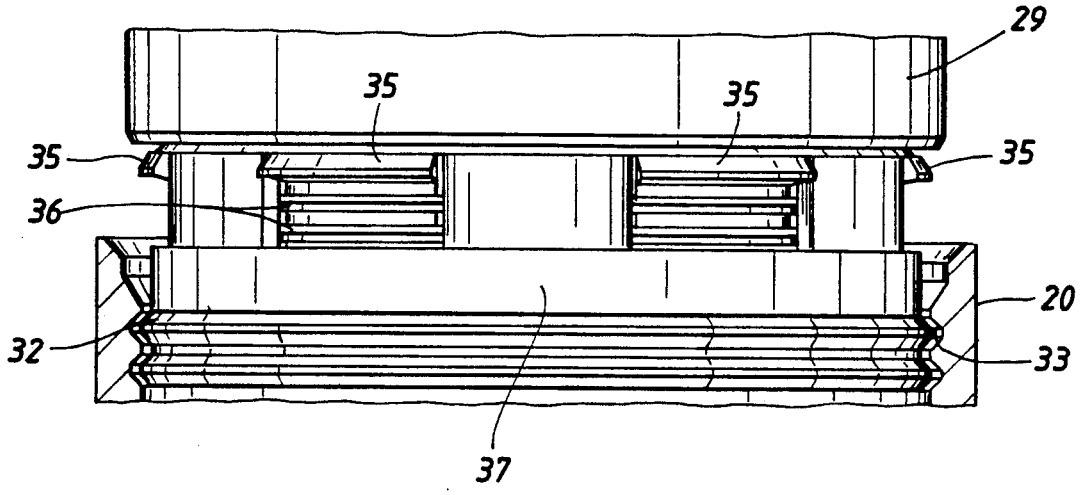
FIG. 8

SUBSEA WELLHEAD EQUIPMENT

This invention relates generally to subsea wellhead equipment of the type in which an inner wellhead housing is lowered into and landed in the bore of an outer wellhead housing in order to install an inner casing string suspended from the inner housing within an outer casing string to which the outer housing is connected, and then locked down in the bore of the outer housing by locking means on the inner housing which is forced into locking engagement with the bore in order to preload the connection between the housings. More particularly, it relates to equipment of this type having an improved assembly for lowering the inner housing into landed position and then causing the locking means to be forced into locked position within the bore of the housing.

In prior equipment of this latter type manufactured and sold by the assignee of the present application, the assembly for landing and then causing the inner housing to be locked down within the bore of the outer housing included a body having a bore therethrough connectable to the inner housing and suspended from a pipe string for lowering the inner housing with the body into landed position, and an actuating sleeve carried by the body for movement between an upper position, as the inner housing was so lowered, and a lower position, upon landing of the inner housing, to force the locking means on the inner housing into a recess or groove about the bore of the outer housing. The inner housing had a downwardly and inwardly tapered shoulder for landing on a similarly tapered seat in the bore of the outer housing beneath the locking recess, and an inner surface on the locking means was tapered downwardly and outwardly for engaging a similarly tapered surface in the recess so as to preload the connection between the housings upon forcing of the locking ring outwardly into the recess. More particularly, the locking means included a locking ring carried by the inner housing for radial movement with respect to it, and a locking sleeve adapted to be engaged and lowered by the actuating sleeve to cause an inner downwardly and inwardly tapered surface on the ring to slide downwardly over a similarly tapered outer surface about the ring in order to move the ring outwardly into the recess.

During the completion of a well with equipment of this type, cement must be circulated downwardly through the inner casing string and upwardly through the annulus between the inner and outer casing strings. For this purpose, the body of the assembly had a bore therethrough and a well string was suspended from its lower end to form a downward continuation of the pipe string through which the cement was circulated.

In the prior assembly above described, the sleeve was moved from its upper position to its lower position to force the locking means into locking position in response to the supply of fluid under pressure to vertically reciprocating, fluid-actuated operators connected to the sleeve. More particularly, fluid was supplied through the pipe string and out ports in the sides thereof to the operators.

This not only contributed to the size, complexity and cost of the assembly, but also, since it was necessary to drop a dart onto a seat in the pipe string in order to direct fluid to the operators, the cement had to be circulated prior to locking of the inner housing down within the outer housing. Furthermore, the force with which the pistons lowered the sleeve, and thus the preload on the connection between the housings, was limited.

Despite these shortcomings of the prior assembly, the mechanical application of force through the pipe string to activate the sleeve was not an obvious solution. Thus, for one thing, due to the depth at which the wellhead is located beneath the water surface, and thus the long length of the pipe string on which the assembly is lowered, it would be impossible to apply the necessary force by merely forcing the pipe string downwardly. Furthermore, vertical movement of the pipe string in and of itself would not produce any more mechanical advantage in forcing the sleeve downwardly than would the operators of the prior assembly.

It is therefore the object of this invention to provide subsea wellhead equipment of this type in which the assembly for lowering the inner housing into and causing it to be locked in landed position is considerably less complex, bulky and expensive than the assembly above described, in which cement may be circulated at any stage of installation of the inner housing, after as well as before it is locked down, and, more particularly, in which the sleeve may be lowered in such a manner as to apply force to actuate the locking means with considerable mechanical advantage.

This and other objects are accomplished, in accordance with the illustrated embodiment of the invention, by an assembly which includes, as in the prior assembly, a body adapted to be releasably connected to the inner housing and having a bore therethrough from which a well string may be suspended, and a sleeve guidably mounted about the body for vertical reciprocation with respect to it between its upper and lower positions. In accordance with the novel aspects of this invention, however, the assembly also includes a tubular member adapted to be suspended from a pipe string and connected to the body for vertical reciprocation with respect thereto between upper and lower positions supporting the body therefrom, and means which so connects the tubular member to the body and sleeve that, with the body connected to the inner housing for lowering the inner housing into landed position, the tubular member may be raised with the pipe string from its lower toward its upper position so as to force the sleeve downwardly against the locking means in order to force it into the locking groove. More particularly, the means for so moving the sleeve comprises linkage pivotally mounted on the body and pivotally connected to the tubular member and sleeve on opposite sides of its pivotal mounting on the body. Preferably, this linkage includes a link pivotally mounted on the body about an axis closer to the pivotal connection of the linkage to the sleeve than to the pivotal connection of the linkage to the body. As illustrated, the linkage also includes a second link pivotally connecting the first link to the sleeve, and a third link pivotally connecting the first link to the tubular member.

Thus, the assembly of this invention does not require that the pipe string be closed in order to circulate cement. It may be circulated either prior to or following actuation of the locking means. Furthermore, the assembly is not only less bulky, complex and expensive, but also, due to the above described linkage, permits the sleeve to be lowered through manipulation of the pipe string with considerable mechanical advantage.

In the preferred and illustrated embodiment of the invention, there is a tubular member on the body which is telescopically received in the tubular member of the assembly, and a pin on one and a J-slot on the other of the tubular members to permit the tubular member of the assembly to be rotated and moved vertically with the pipe string from its lower supporting position, as the inner housing is lowered into landed position, toward its upper supporting position as the sleeve is lowered.

In the drawings, wherein like reference characters are used throughout to designate like parts:

FIG. 7 is a cross-sectional view of the assembly as seen along broken lines 7—7 of FIG. 4; and FIG. 8 is a side elevational view of the portion of the assembly including the lower end of the sleeve and the locking means, but with a portion of the upper end of the outer wellhead housing broken away to show details of the locking means carried by the lower inner wellhead housing.

Figure 1:
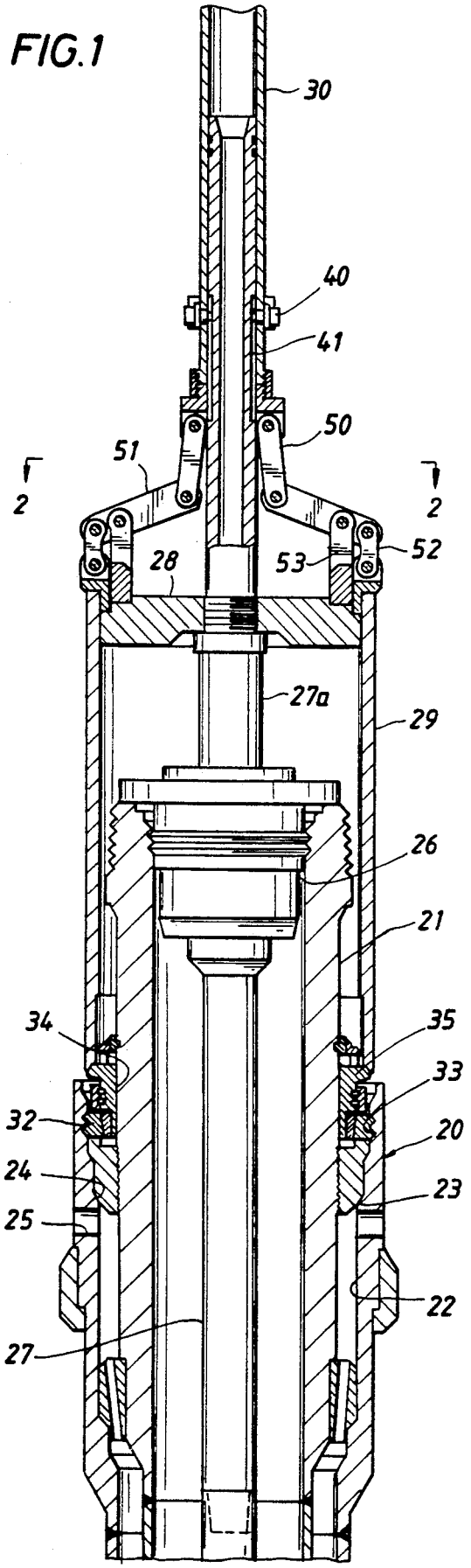
FIG. 1 is a vertical sectional view of an assembly constructed in accordance with the present invention and with the sleeve thereof lowered in order to cause an inner wellhead housing to be locked in the bore of an outer wellhead housing in which it has landed.
Figure 2:
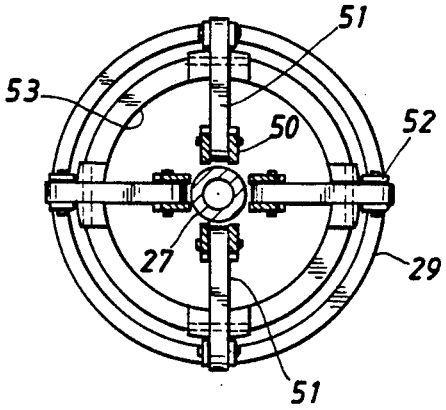
FIG. 2 is a cross-sectional view of the assembly, as seen, long broken lines 2—2 of FIG. 1.

As best shown in FIG. I, the outer wellhead housing 20 has been installed on the upper end of an outer wellhead casing, typically at a subsea level, and an inner wellhead housing 21 has been lowered into the bore 22 of the outer housing so as to suspend an inner casing string therefrom within the outer casing. More particularly, the inner housing 21 has a shoulder 23 thereabout for landing on the seat 24 in the bore of the outer housing above a side outlet 25 in the outer housing and passageways in its lower end forming a continuation of the annulus between the inner and outer housings. As previously described, locking means including a locking ring 32 is carried about the inner housing for disposal opposite a locking groove 33 in the bore of the outer housing about the seat 24, when the inner housing is landed therein, so that, as will be described, the inner housing may be locked down in landed position to preload the connection between the inner and outer housings.

The inner housing has been lowered into and caused to be locked in its landed position by means of an assembly which, as above described, includes a tubular body 26 releasably connected to the bore of the inner housing and having a well string 27 suspended therefrom to form a lower continuation of a bore (not shown) through the body 26. As shown, the housing 26 includes a tubular extension 27A extending upwardly from its bore and having a radially enlarged head 28 about an intermediate portion thereof, and an actuating sleeve 29 is guidably reciprocal about the head 28 and thus the body between an upper position, as the inner housing is lowered into landed position with the assembly, and a lower position, upon landing of the inner housing, in order to move the locking means into the locking position within the recess 31, as shown in FIG. 1.

Figure 6:
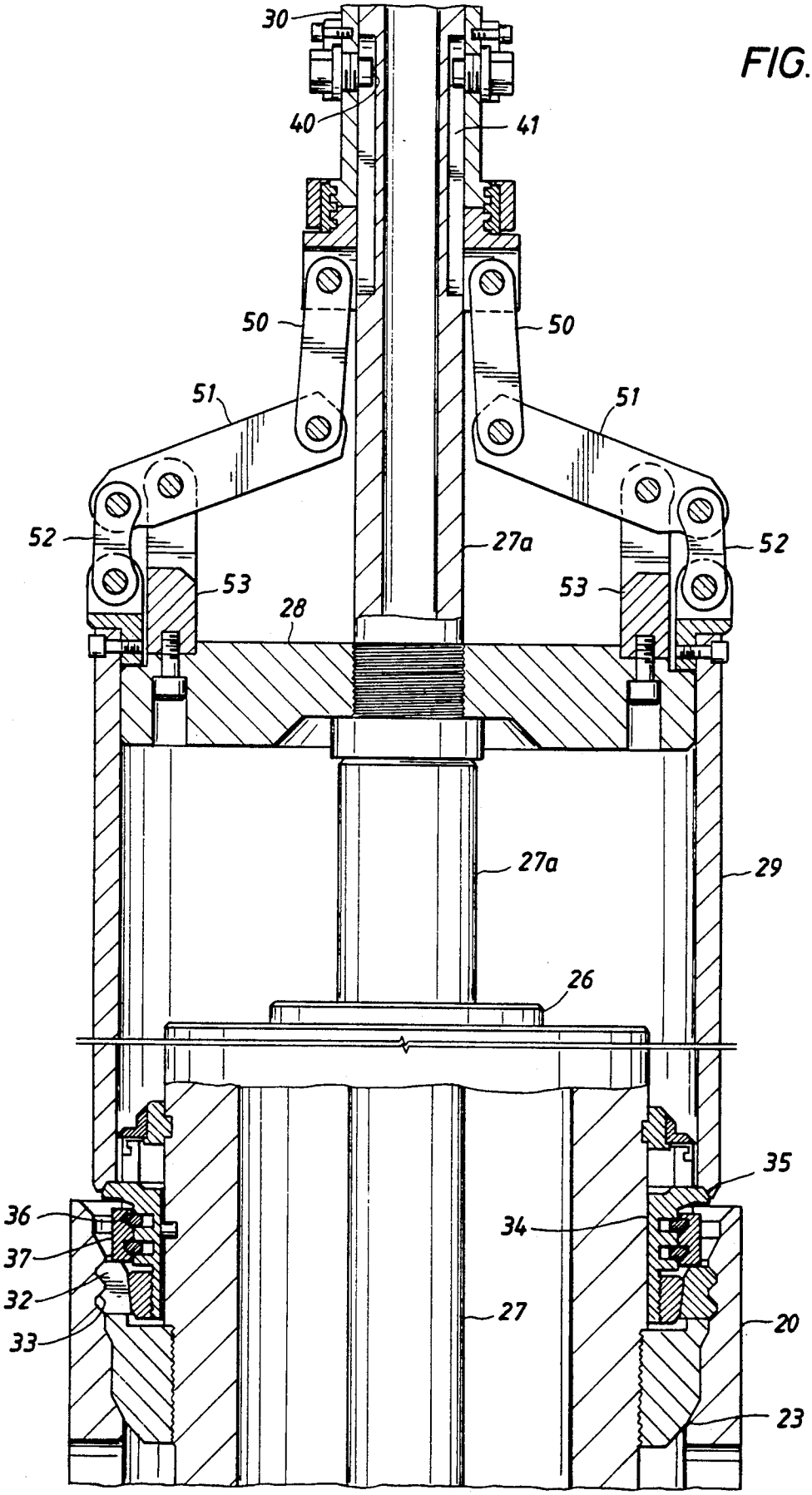
FIG. 6 is a view similar to FIG. 5, but upon further raising of the outer tubular member with the pipe string to further lower the cam ring of the locking means to move the locking ring into the groove in the bore of the outer wellhead housing, and thus preload the connection between the inner and outer wellhead housing.

More particularly, and as will be described, the actuating sleeve 29 is adapted to be moved from its upper position to its lower position by means of an outer tubular member 30 suspended from the pipe string for raising and lowering the assembly therewith, and adapted to support the tubular member 27, and thus the body 26 as a whole, in both an upper position, as shown in FIG. 1, and a lower position of the tubular member 30, as shown in FIG. 6. More particularly, the tubular member 30 is connected to the sleeve 29 and the body by linkage to be described which is so constructed as to raise the sleeve when the tubular member 30 is in its lower supporting position and lower the sleeve as it is moved from its lower supporting position to its upper supporting position. Consequently, the body of the assembly is supported from the tubular member 30 and, thus, the pipe string, during both lowering of the assembly with the wellhead housing as well as raising of the assembly from the wellhead housing following locking down of the inner wellhead housing within the outer wellhead housing.

With reference now to FIGS. 4–7, the locking recess 33 in the bore of the inner wellhead housing has a pair of locking grooves thereabout, and the locking ring 32 has a pair of locking teeth thereabout for fitting within the grooves in the locking recess. More particularly, the locking ring 32 is split about its circumference so as to normally assume the radially inner position shown in FIG. 4, wherein its teeth are removed from the grooves in the locking recess so as to permit the locking ring to be moved into a position opposite the recess. Thus, as in the case of the locking means of the above described apparatus previously made and sold by the assignee of this application, the normally retracted locking ring 32 is adapted to be expanded outwardly by means of a cam ring 34 vertically slidable about the upper end of the inner wellhead housing. Thus, the ring has a flange 35 on its upper end which is positioned to be engaged by the lower end of the sleeve 29 as the sleeve is lowered so as to in turn lower the cam ring, and, thus causes its inner wedging surface to slide downwardly along a similarly tapered surface on the outer circumference of the locking ring 32 to force the ring outwardly into the locking groove in the outer wellhead housing. More particularly, these surfaces are formed on a relatively small angle with respect to the vertical to cause the ring to be forced outwardly with considerable mechanical advantage.

Figure 4:
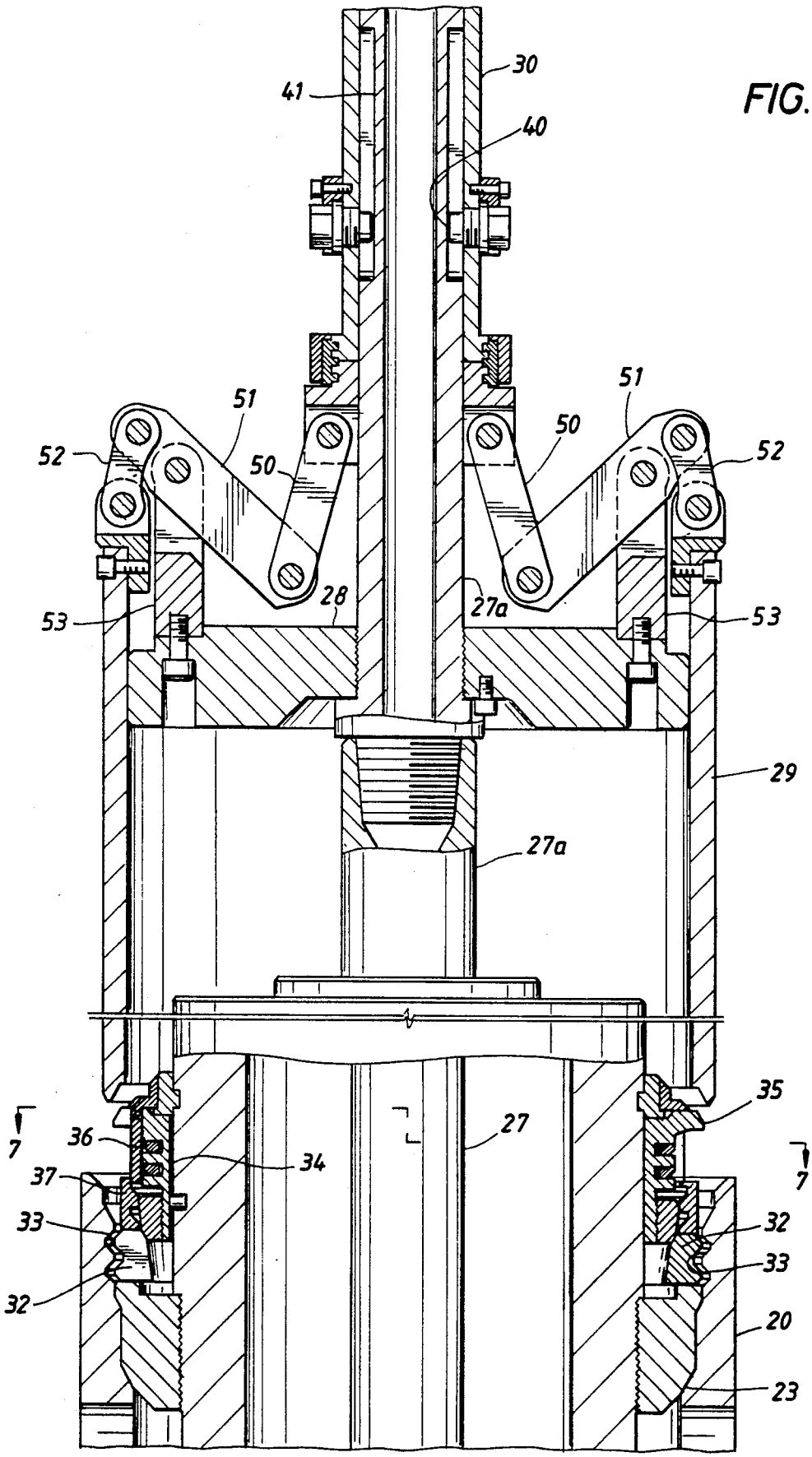
FIG. 4 is an enlarged vertical sectional view, broken away intermediate its length, showing the position of the assembly including the pin and J-slot connections when the sleeve is in its raised position during lowering of the inner wellhead housing.

As was also the case in the previously described apparatus manufactured and sold by the assignee of this application, the cam ring is adapted to be held down by means of normally expanded split rings 36 carried within grooves about its outer diameter. Prior to lowering the sleeve, as shown in FIG. 4, the normally expanded rings are held in contracted positions by means of a sleeve depending from an upper bracket about the inner wellhead housing. However, as the cam ring is lowered in response to lowering of the sleeve 29, the outer ends of the split rings are freed to move outwardly into grooves formed on the inner diameter of a ring 37 supported by the inner housing above the locking ring 32, whereby the locking ring is locked in locking position.

Figure 3:
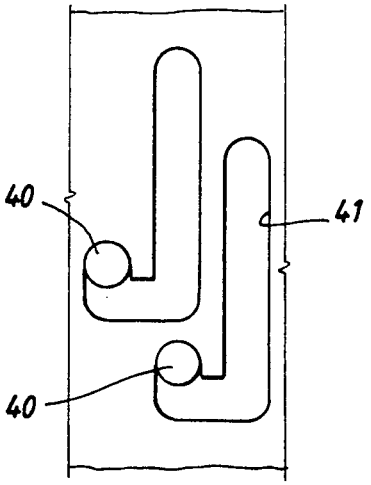
FIG. 3 is an enlarged detail view of the pin and J-slot connections between the tubular members of the assembly and body in positions they would assume to support the inner tubular member from the outer tubular member during lowering of the assembly to land the inner housing within the outer housing.

The outer tubular member 30 supports the inner tubular member 27 of the body of the assembly in both the raised and lowered positions of the upper tubular member by means of pins 40 on the outer member for fitting within J-slots 41 in the outer surface of the inner tubular member 27 of the body of the assembly. As will be understood from FIGS. 3 and 4, as the inner wellhead housing is lowered with the assembly, the pins on the outer tubular member 30 occupy the short leg of the J-slot so as to support the body in the lowered position of the outer tubular member. However, in order to raise the outer tubular member 30 with respect to the inner tubular member, the outer tubular member need only be lowered with the pipe string to move the pins out of the short legs of the J-slots and then rotate it a short distance to permit the pins to be moved upwardly within the long legs of the J-slots, as shown in FIG. 6.

As will be described, in order to lower the sleeve in order to set the locking means in the groove of the inner wellhead housing, outer tubular member is raised to move its pins further upwardly toward the long legs of the J-slots. Obviously, upon locking of the inner wellhead housing within the outer wellhead housing, and disconnection of the body 26 from the inner wellhead housing member, the outer tubular member may be raised with the pipe string to lift the assembly from the inner wellhead housing. At this time, of course, the pins would be free to move upwardly into the upper ends of the long legs of the J-slots, and thus support the inner tubular member of the body of the assembly therefrom for retrieval of the remainder of the assembly.

As previously described, the connection of the outer tubular member 30 to the body and the sleeve 29 for moving the sleeve between its upper and lower positions comprises linkage including a first link 50 pivotally connected at one end to the outer tubular member and at the opposite end to a second link 51 pivotally connected at its opposite end to a relatively short link 52 pivotally connected to the upper end of the sleeve 29. The linkage is supported from the body, and particularly the head 28, by means of an upstanding ring 53 which is pivotally connected to the link 51 intermediate the pivotal connection of its ends to the links 50 and 52.

Figure 5:
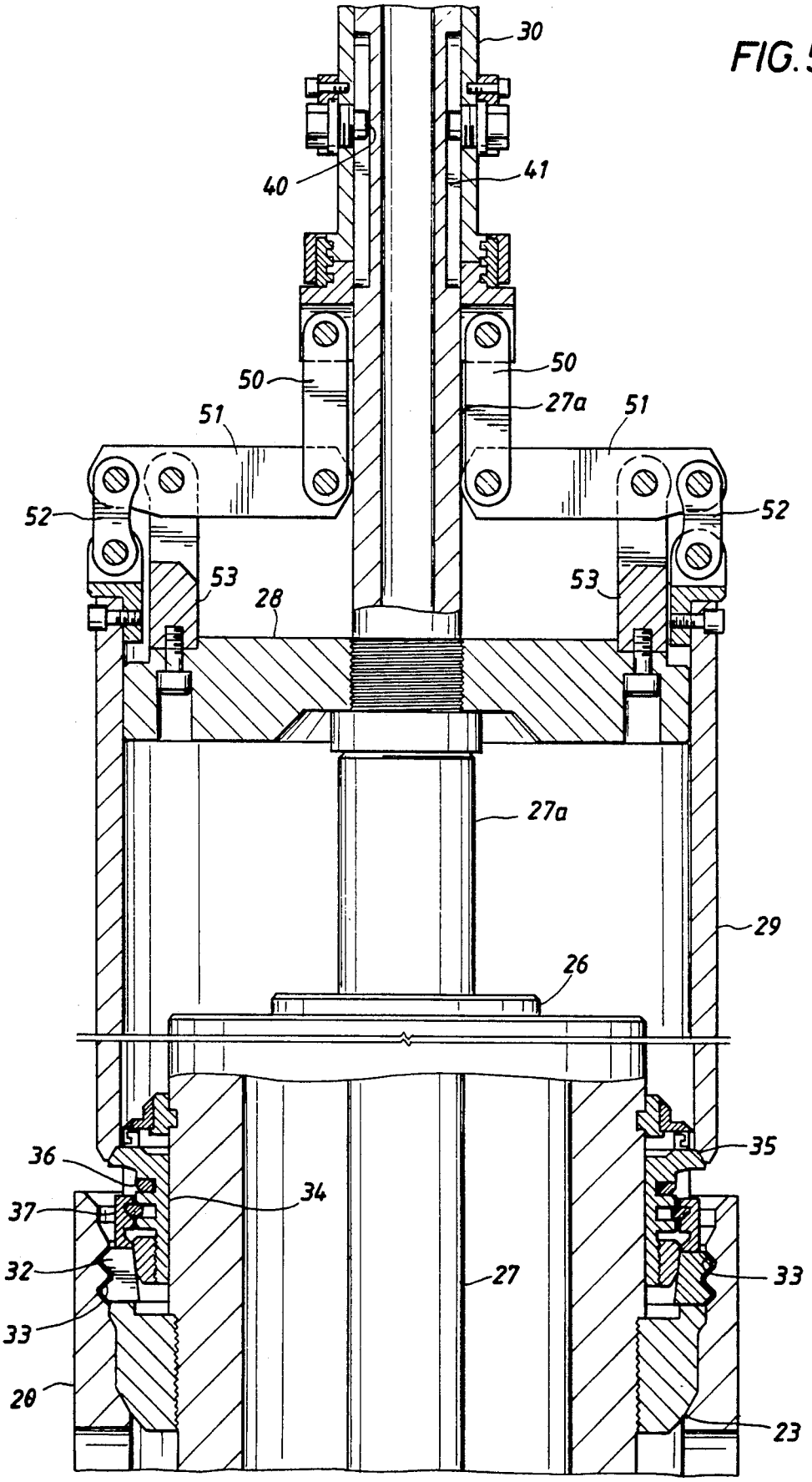
FIG. 5 is a view similar to FIG. 4, but upon initial lifting of the outer tubular member with the pipe string to lower the sleeve into engagement with the cam ring of the locking means carried by the inner wellhead housing.

As shown in FIG. 4, when the outer tubular member is in its lower supporting position, the links 50 and 51 form a relatively deep "V" with respect to one another, and the pivotal connection of the link 51 to the link 52 is somewhat within the pivotal connection of the link 52 to the upper end of the sleeve. Then, as the outer tubular member is first raised, as shown in FIG. 5, the link 52 will assume a more upright position and the links 50 and 51 will move into a substantially right-angle relation with one another. Then, upon continuing upward movement of the outer tubular member, and as shown in FIG. 6, the links 52 will move into an even more upright position as the left-hand ends of the links 51 are raised.

As previously mentioned, and as can be seen from the drawings, the pivotal connection of the arm 53 to the link 51 is closer to the connection of the link 51 to the link 52 than to its connection to the link 50. More particularly, the ratio of its distance between the pivotal connections is on the order of 1:2, thus providing a 2:1 mechanical force advantage as the outer tubular member is raised to lower the sleeve in order to expand the locking ring into locking position. This, coupled with the mechanical advantage resulting from the small vertical angle formed between the wedging surfaces of the cam ring and locking ring, as well as the ability to transmit a large downward force on the sleeve by pulling up the pipe string, provides a preloading force having considerable over-all mechanical advantage.

To summarize, in order to lock the inner wellhead housing within the outer wellhead housing, the outer tubular member 30 is moved into its upper position and then lowered with the pipe string to lower the well string suspended from the body 26 into the inner wellhead housing for connection therewith. At this time, the actuating sleeve 29 is in its upper position, as shown in FIG. 6, so that its lower end will not prematurely activate the locking means. Upon connection of the body to the outer housing, the outer member is raised by the pipe string to lower the sleeve and thus engage and force the cam ring downwardly to force the locking ring into the locking recess of the outer wellhead housing and cause it to be locked in locking position.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Subsea wellhead equipment, comprising an outer wellhead housing having a bore therethrough and connectable to the upper end of an outer casing, an inner wellhead housing having a bore therethrough and adapted to be landed within the bore of the outer housing for suspending an inner casing within the outer casing, locking means carried by the inner housing for movement into locking engagement with the bore of the outer housing when landed therein, and an assembly for lowering the inner housing into and locking it in landed position within the bore of the outer housing including a body adapted to be releasably connected to the inner housing and having a bore therethrough, a tubular member adapted to be suspended from a pipe string, means connecting the tubular member to the body for vertical reciprocation with respect thereto between upper and lower positions supporting the body therefrom, a sleeve guidably mounted about the body for vertical reciprocation with respect thereto, and means responsive to raising of the tubular member with the pipe string from its lower toward its upper body supporting position for moving the sleeve from an upper to a lower position in which, with the body connected to the inner housing and the inner housing landed in the bore of the housing, the sleeve forces the locking means on the inner housing into locking engagement with the bore of the outer housing.

2. Subsea wellhead equipment of the character defined in claim 1, wherein the means for so moving the sleeve comprises linkage pivotally mounted on the body and pivotally connected to the tubular member and sleeve on opposite sides of its pivotal mounting on the body.

3. Subsea wellhead equipment of the character defined in claim 2, wherein the linkage includes a link pivotally mounted on the body about an axis closer to the pivotal connection of the linkage to the sleeve than to the pivotal connection of the linkage to the body.

4. Subsea wellhead equipment of the character defined in claim 3, wherein said linkage also includes a second link pivotally connecting the first link to the sleeve, and a third link pivotally connecting the first link to the tubular member.

5. Subsea wellhead equipment of the character defined in claim 1, wherein said connecting means includes a tubular member on the body which is telescopically received in the tubular member of the assembly, and a pin on one and a J-slot on the other of the tubular members to permit the tubular member of the assembly to be rotated and moved vertically with the pipe string between its lower supporting position in which the pin is in the lateral leg of the J-slot, as the inner housing is lowered into landed position, and its upper supported position in which the pin is in the long leg of the J-slot as the sleeve is lowered.

6. Subsea wellhead equipment of the character defined in claim 1, wherein the bore of the outer housing has a locking groove thereabout, and the locking means is carried by inner housing in position to be expanded into the groove by lowering of the sleeve.

7. For use with subsea wellhead equipment which comprises an outer wellhead housing having a bore therethrough and connectable to the upper end of an outer casing, an inner wellhead housing having a bore therethrough and adapted to be landed within the bore of the outer housing for suspending an inner casing within the outer casing, and means carried by the inner housing for movement into locking engagement with the bore of the outer housing when landed therein, and an assembly for lowering the inner housing into and locking it in a landed position within the bore of the outer housing with the bore thereof, including a body adapted to be releasably connected to the inner housing and having a bore therethrough, a tubular member adapted to be suspended from a pipe string, means connecting the tubular member to the body for vertical reciprocation with respect thereto between upper and lower positions supporting the body therefrom, a sleeve guidably mounted about the body for vertical reciprocation with respect thereto, and means responsive to raising of the tubular member with the pipe string from its lower toward its upper body supporting position for moving the sleeve from an upper to a lower position in which, with the body connected to the inner housing and the inner housing landed in the bore of the housing, the sleeve forces the locking means on the inner housing into locking engagement with the bore of the outer housing.

8. An assembly of the character defined in claim 7, wherein the means for so moving the sleeve comprises linkage pivotally mounted on the body and pivotally connected to the tubular member and sleeve on opposite sides of its pivotal mounting on the body.

9. An assembly of the character defined in claim 8, wherein the linkage includes a link pivotally mounted on the body about an axis closer to the pivotal connection of the linkage to the sleeve than to the pivotal connection of the linkage to the body.

10. An assembly of the character defined in claim 9, wherein said linkage also includes a second link pivotally connecting the first link to the sleeve, and a third link pivotally connecting the first link to the tubular member.

11. An assembly of the character defined in claim 7, wherein said connecting means includes a tubular member on the body which is telescopically received in the tubular member of the assembly, and a pin on one and a J-slot on the other of the tubular members to permit the tubular member of the assembly to be rotated and moved vertically with the pipe string between its lower supporting position in which the pin is in the lateral leg of the J-slot, as the inner housing is lowered into landed position, and its upper supported position in which the pin is in the long leg of the J-slot as the sleeve is lowered.

12. An assembly of the character defined in claim 7, wherein the bore of the outer housing has a locking groove thereabout, and the locking means is carried by inner housing in position to be expanded into the groove by lowering of the sleeve.

* * * * *